US005392957A

United States Patent [19]

Parsons

[11] Patent Number: 5,392,957

[45] Date of Patent: Feb. 28, 1995

[54] LIQUID DISPENSING APPARATUS

[76] Inventor: William Parsons, 10074 Devonshire Dr., Baton Rouge, La. 70809

[21] Appl. No.: 191,469

[22] Filed: Feb. 4, 1994

[51] Int. Cl.[6] ..... B67B 7/00

[52] U.S. Cl. ..... 222/1; 222/185; 222/529; 222/530; 251/9; 285/177; 285/345; 277/205

[58] Field of Search ..... 222/185, 214, 484, 517, 222/529, 558, 530, 552, 556, 1; 251/9; 277/168, 205, 212 C, 184, 186; 285/177, 345

[56] References Cited

U.S. PATENT DOCUMENTS

| | | | |
|---|---|---|---|
| 327,401 | 9/1885 | Low | 285/345 X |
| 3,042,267 | 7/1962 | Reynard | 222/484 X |
| 3,539,081 | 11/1970 | Norton et al. . | |
| 4,260,078 | 4/1981 | Kephart . | |
| 4,269,333 | 5/1981 | Nakai et al. | 222/484 |
| 4,386,718 | 6/1983 | Stewart et al. . | |
| 4,513,885 | 4/1985 | Hogan . | |
| 4,646,944 | 3/1987 | Sanderson . | |
| 4,651,898 | 3/1987 | Bell . | |
| 4,715,516 | 12/1987 | Salvail . | |
| 4,722,463 | 2/1988 | Anderson | 222/484 X |
| 4,911,334 | 3/1990 | Kedzierski . | |
| 4,928,855 | 3/1990 | Ramsey . | |
| 4,932,544 | 6/1990 | Glazer . | |
| 4,932,561 | 6/1990 | Boxall . | |
| 5,024,353 | 6/1991 | Horne . | |
| 5,139,182 | 8/1992 | Appla . | |
| 5,244,021 | 9/1993 | Hau | 222/530 X |

*Primary Examiner*—Gregory L. Huson
*Attorney, Agent, or Firm*—Robert Montgomery

[57] ABSTRACT

This invention relates to dispensing devices attached to such liquid containers as plastic gallon jugs. More particularly the apparatus is used to dispense the contents of such containers without lifting the container. A simple device is disclosed for attachment to disposable bottles and jugs which allows small children, elderly and the handicapped to dispense liquids from such containers. One embodiment provides a controllable tilt-and pour arrangement while a second embodiment provides a head for supporting the container in the inverted position and further provides a flexibly attached dispensing valve for directing the container's contents into a receptacle while the container is positioned on the edge of a counter or refrigerator shelf.

17 Claims, 7 Drawing Sheets

LIQUID DISPENSING APPARATUS

BACKGROUND OF THE INVENTION

1. Field of the Invention

This invention relates generally to disposable container closure devices and more particularly to closures used to assist in the dispensing of refrigerated liquids from such disposable containers without lifting the container.

2. General Background

Small children, the elderly and the handicapped often experience a great deal of difficulty when pouring liquids from disposable containers, such as, two and three liter, plastic soft drink, gallon milk and juice containers, especially when the containers are full. Such containers are usually heavy and irregular shaped making them awkward to handle. As a result the containers are usually placed on a counter or table in their upright position while an attempt is made to "tilt and pour" the liquid into a glass. The liquid being poured from such containers usually flows too suddenly or irregularly due to one's inability to control the flow. There is also the phenomenon known as "glugging" caused by large air bubbles forming in the container resulting in erratic flow rates. These problems usually result in a great deal of spillage.

Various devices have been developed for closing and controlling the flow of liquids. Examples such as those disclosed by U.S. Pat. No. 5,139,182 to Appla and U.S. Pat. No. 4,932,544 to Glazer. However, such devices still depend on the user's ability to lift and manipulate the container while directing a stream into a cup or glass.

Various devices have also been developed for dispensing liquids from large bulk containers such as milk and juice dispensers which have collapsible bags or non-disposable containers having dispensing valves. In the latter case the liquid must be transferred from a disposable container to the dispensing device. Such devices are depicted by U.S. Pat. Nos. 4,513,885 by Hogan; 4,651,898 by Bell; 4,932,561 by Boxall; 4,928,855 by Ramsey and 4,911,334 by Kedzierski. These dispensers are simply too large, inconvenient or not practical for home use with refrigerated beverages having disposable containers.

Dispensing apparatus have been developed for refrigerated disposable bottles as well. Such apparatus control the flow of liquid being dispensed by opening and closing liquid lines and vent tubes by means of a valve body. Examples of such dispensing apparatus are disclosed by U.S. Pat. Nos. 3,539,081; 4,260,078; 4,386,718; 4,646,944; 4,715,516; and 5,024,353.

U.S. Pat. No. 4,260,078 to Kephart seems to be the closest relevant prior art to the instant invention by disclosing a method for attaching a dispenser to a disposable bottle whereby the bottle and the attachment are inverted for positioning on a refrigerator shelf, and the contents are dispensed through a flexible tube having a manually operated valve for controlling the liquid flow into a cup or glass. The disclosed apparatus is limited in application and over simplifies the structure required in several ways. Although it is suggested that the apparatus should be sufficient to support the container, a cylindrical cup only slightly larger than the container seems insufficient for large or tall containers and would be impractical for gallon jugs having irregular shapes. No provision is made for gripping the apparatus and maintaining the proper orientation when attempting to threadably attach the device to a bottle. Although mentioned, no method for securing the long flexible tubes to the attachment portion is disclosed. It is further indicated that there is a need to secure the manual valve to the support body, but only when the container is to be placed on a table. However, no such securing means is disclosed. Kephart also suggested that if the container is not cylindrically round, the body portion of the apparatus can be contoured to fit. This is simply impossible unless a new embodiment is to be designed for each irregular shaped container. If the apparatus is contoured to fit the container it can not be screwed onto the container, in which case a new embodiment utilizing a clamping device for sealing is suggested but not disclosed. A dispensing means is suggested in the specification by the prior art for simultaneously opening and closing the flexible liquid and vent tubes by depressing a "knob". However, no such structure is disclosed and is inconsistent with the claims which refer to a much more complicated valve mechanism using a screw clamp means which is unsupported by the specification. Therefore, it would seem that U.S Pat. No. 4,260,078 is inconclusive as to how to make and use the invention and is not sufficient in its teachings to meet the needs suggested by the present invention.

SUMMARY OF THE PRESENT INVENTION

The present invention addresses the issues discussed above by providing those with handicaps, elderly and small children with an operative means for dispensing liquids from large awkward containers without lifting. In addition, such containers are often refrigerated where space is at a premium. Although dispensing devices are well known in the art, as discussed above, there are a number of inherent problems which the present invention overcomes.

In accordance with the objectives and the principles of the invention, there is provided in one embodiment a liquid dispensing, closure head for attachment to a plastic jug. This embodiment provides a means for dispensing the contents of the jug by tilting the jug while supported on a counter or the like and pouring the liquid into a second container. This apparatus is sealed to atmosphere by a hand operated spring loaded cap. Unlike other internal, liquid container vents, this embodiment utilizes a special curved flexible tube serving as an air vent, and is orientated in a manner so that when the jug is tilted, the end of the vent tube is positioned in the natural occurring air pocket of the jug. A liquid passage is also provided through the head to allow for smooth flow. A self-conforming seal, attached to the head, permits the head to be attached to the container in a manner which conforms to both the inside of the jug's neck opening and around the neck's external ridges or threads, irrespective of such thread or ridge configuration, thereby providing a more effective liquid seal. The spring loaded cap provides an atmospheric seal, and when manually operated it allows access to the liquid and air vent ports. A simple hand movement opens the cap to either the "held open" or "locked open" position for pouring. Air is allowed to flow freely through the air tube thus preventing glugging. Dripping is also reduced as a result of a counter boring the external liquid port.

In a second embodiment, the liquid dispensing, closure head technology is expanded to allow for the inversion of the container by incorporation of a support base approximately the size of the container. The support base is configured in a manner which assists the user in attaching the apparatus to the container by providing finger slots for aligning the apparatus and securely tightening it on the container. A support ring for plastic gallon jugs and the like is also provided which provides support for such thin wall containers, so they can be placed in the inverted position. This configuration allows the liquid and vent ports to be extended beyond the closure head with the addition of flexible tubes attached to a pinch valve for sealing both the liquid and vent tubes, thus replacing the spring loaded cap covering the external ports in the head. Therefore, the valve, being flexibly attached, allows the user to hold a receptacle in one hand while operating the valve with the other. The pinch valve is secured magnetically to the head in a manner which provides additional sealing by crimping the tubes when not in use. It is essential that the tubes be kept short so as to reduce the problem of cleaning, unintentional tube crimping, air entrapment, leaking, and space requirement.

It is, therefore, an object of this invention to provide a device which assists small children, the elderly and the handicapped in pouring a beverage from a disposable container with the container inverted, resting on a table or counter, or dispensed directly from the container while in a refrigerator.

It is another object of the present invention to provide a universal adaptor for attachment to plastic, gallon jugs and the like which comprises a pinch type valve body, magnetically attached thereto when not in use.

It is still a further object of the present invention to provide a device for tilt-and-pour which can be adapted for use on gallon jugs or three liter, soft drink, type plastic, disposable bottles.

DETAILED DESCRIPTION OF THE PREFERRED EMBODIMENT

Figure 1:
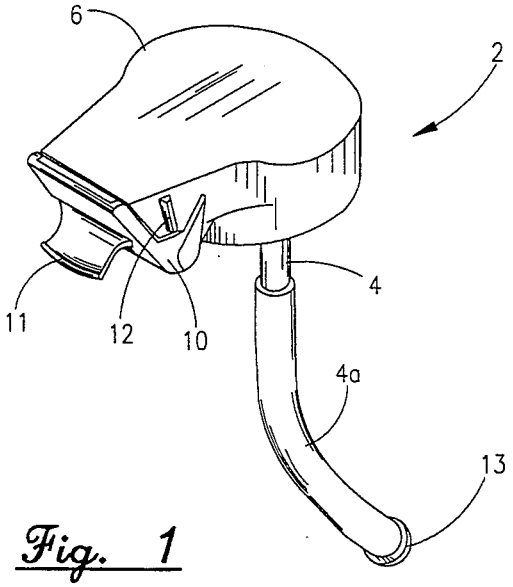
FIG. 1 is an isometric view of the "tilt and pour" embodiment of the preset invention.
Figure 2:
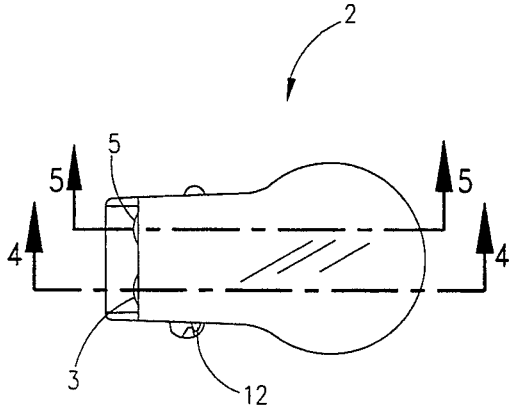
FIG. 2 is a plan view of the "tilt and pour" embodiment of the present invention.
Figure 3:
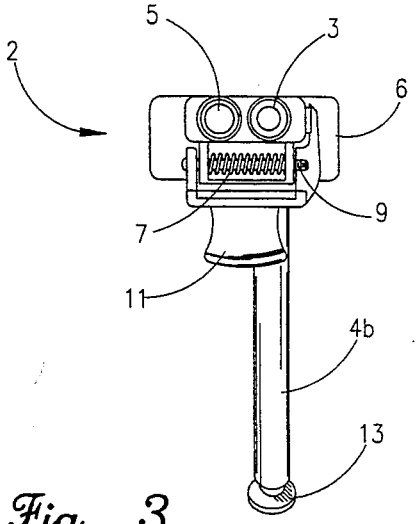
FIG. 3 is a front elevation of the "tilt and pour" embodiment of the present invention.
Figure 4:
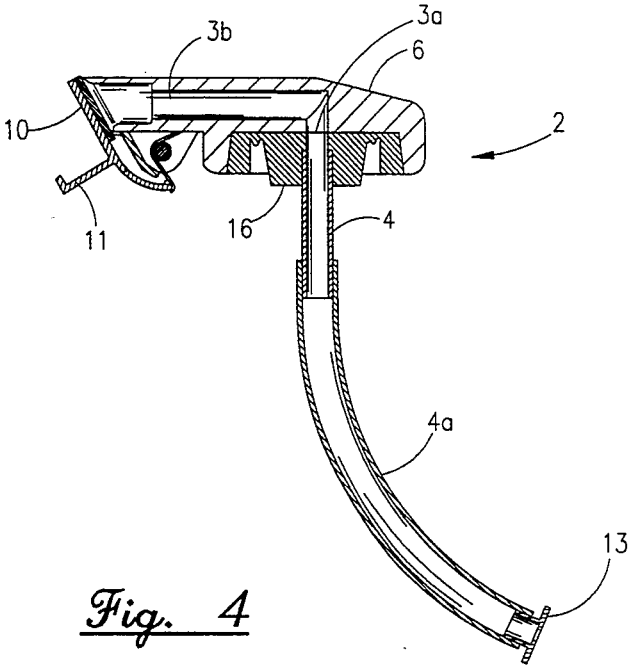
FIG. 4 is a cross section view of the "tilt and pour" embodiment taken along sight line 4—4 in FIG. 2.
Figure 5:
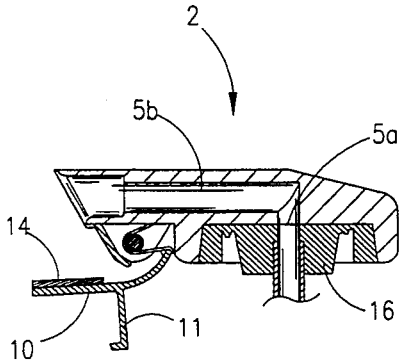
FIG. 5 is a cross section view of the "tilt and pour" embodiment taken along sight line 5—5 in FIG. 2 showing the spring loaded cap in the open position.
Figure 6:
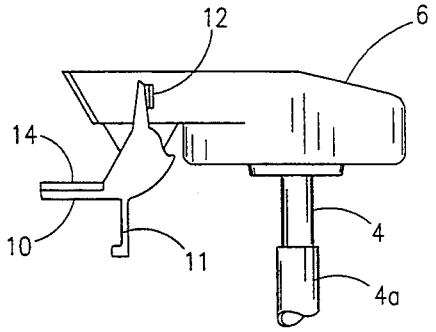
FIG. 6 is a right side view of the "tilt and pour" embodiment shown with the cap in the latched open position.
Figure 7:
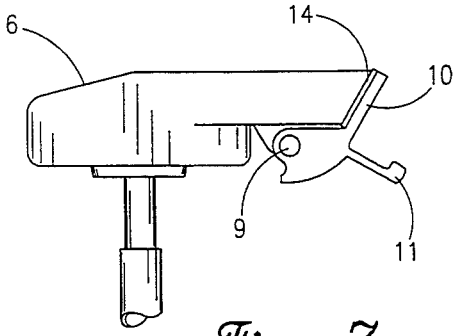
FIG. 7 is a left side view of the "tilt and pour" embodiment showing the spring loaded cap in the closed position.
Figure 8:
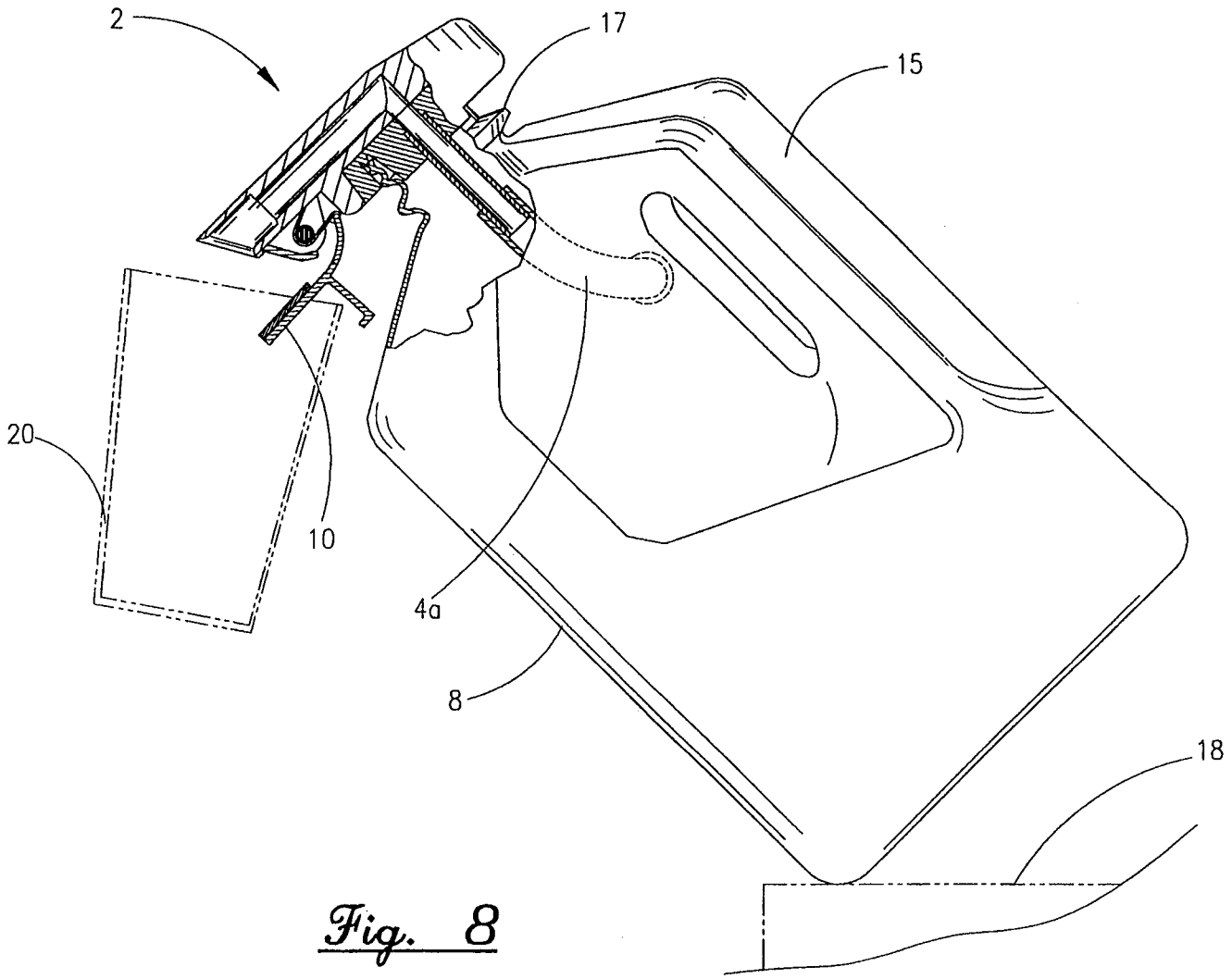
FIG. 8 is a partial section view of the "tilt and pour" embodiment in relation to a plastic gallon jug, a table and a glass, shown in the pour position.

Referring, now more explicitly, to the drawings described above, FIG. 1 illustrates a simple, rigid head 2 arrangement having a vent tube 4, a portion 4*a* of which is flexible and purposely curved to allow the end to extend into the natural air space which occurs at the highest point near the handle portion 15 of a plastic gallon jug when tilted. The head assembly 2 is fitted with a deformable seal portion 16 which is configured to be secured about the neck of a disposable, liquid container such as plastic soft drink bottles or gallon jugs 8, as seen in FIG. 8, usually used for milk or juice thereby replacing the container's existing cap. As seen in FIGS. 2 and 3, the head 2 also has a liquid port 5 for allowing the contents of such containers to be dispensed when the cap 10 is opened. As seen in FIG. 4, the rigid vent tube 4 is inserted in the flexible, seal coupling 16 and is communicative with the vent port 3*a*. The vent tube rigid portion 4 extends some distance below the seal portion 16 before being extended by a curved flexible tube 4a. This arrangement allows for both the removal of the curved, flexible tube 4*a*, and the cleaning, with a flexible brush, the vent tube 4, flexible tube 4*a*, and the liquid cavities 3*b* and 5*b* as seen in cross section in FIGS. 4 & 5. The flexible vent tube 4*a* is also fitted with an orifice reducer 13 to reduce the quantity of air entering the beverage container and help prevent liquid back flow. The cavities 3*b* and 5*b*, simply passages which provide a communicative path through the head 6 and the flexible coupling 16, connects the external ports 3, 5 to the liquid and vent ports 3*a*, 5*a* inside the container. Thus, when cavity 3*b*, is vented to atmosphere, liquid flow through cavity 5*b* is permitted to the outlet port 5 located at the edge of the head 6. It should be noted that vent tube 4 could be installed in either inlet port 3*a* or 5*a*. The spring loaded, manually operated cap 10 is held securely against the face of the two external ports 3, 5 providing closure of both ports by a torsion spring 7 surrounding the hinge pin 9. The cap 10 is operated by the handle 11 curled outwardly from the cap 10. An indent projection 12 is also provided as a means for retaining the cap 10 in the open position shown in FIG. 6. A seal 14 shown in FIG. 5 is attached to the inner face of the cap 10 to provide atmospheric sealing for the external porting A flexible coupling 16 is provided for connecting the head 6 to a disposable jug or plastic container 8. The coupling 16 is made of a resilient material having sealing capability for the open container's leading edge as well as the inner and outer neck diameters. The flexible coupling 16 although somewhat dependent on the container's threads or external protrusions for gripping and holding the container in position does not depend on the exact configuration of such protrusions for sealing. The head 2 is simply pressed in place while rotating, thus insuring a secure, snug, friction fit in and around the container's neck 17 regardless of the thread or protrusion configuration and thus providing a sufficient liquid seal between the container's open neck 17 and the head coupling 16 as seen in FIG. 8. To operate the tilt and pour apparatus 2, the container 8 is simply placed on a table, refrigerator shelf, or counter top 18, as shown in FIG. 8. A glass or cup 20 is brought to the dispensing head 2 with one hand, the cap 10 is opened via the handle 11, the container is then tilted while resting on the counter top or refrigerator shelf, to the pour position with the other hand holding the container. In some instances, as with small children, the glass and dispensing container, such as a disposable bottle, can be placed on the same table or counter, thereby allowing both hands to be used to hold the dispenser container 8 while releasing the contents into the glass.

Figure 9:
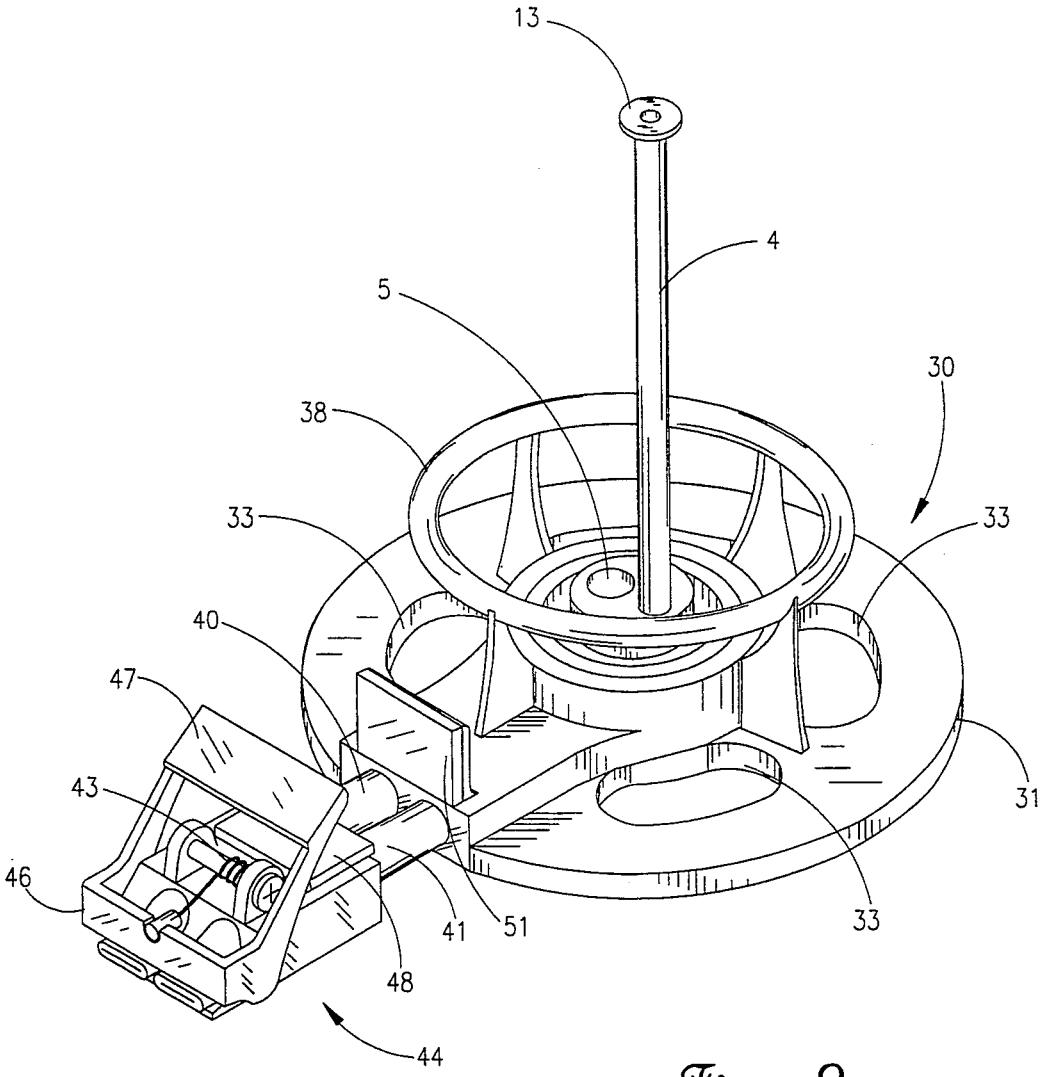
FIG. 9 is an isometric view of the second embodiment of present invention utilized as an inverted support base with the pinch valve flexibly attached.
Figure 10:
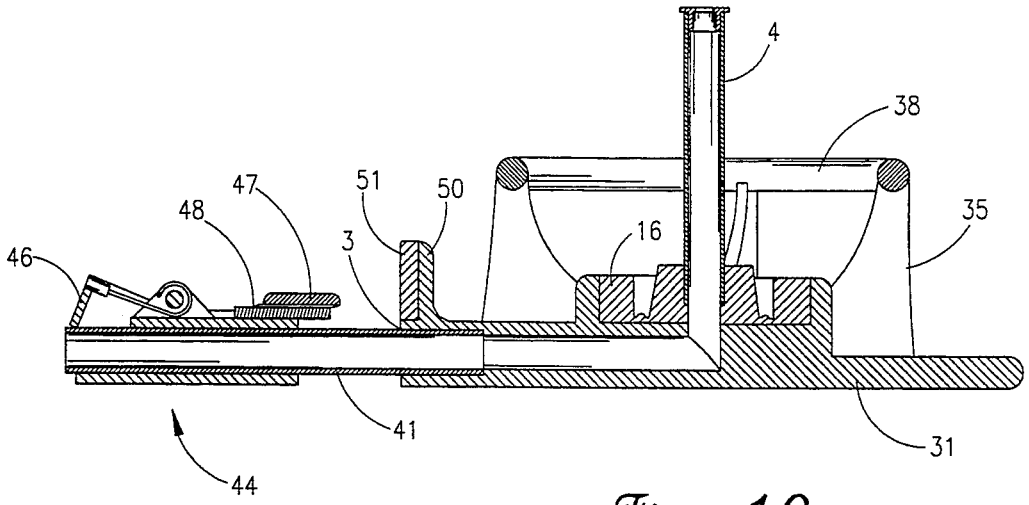
FIG. 10 is a cross section view taken along sight line 10—10 in FIG. 12 showing the pinch valve attached and in the extended open position.
Figure 11:
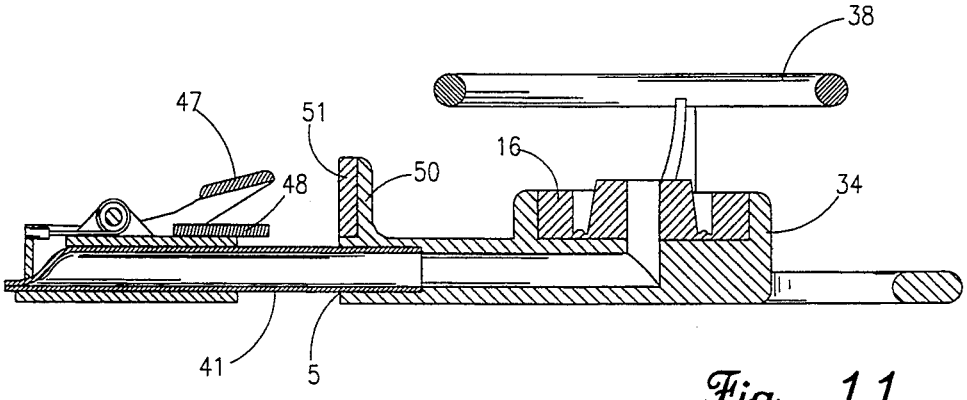
FIG. 11 is a ross section view taken along sight line 11—11 in FIG. 12 showing the pinch valve in the extended but closed position.
Figure 12:
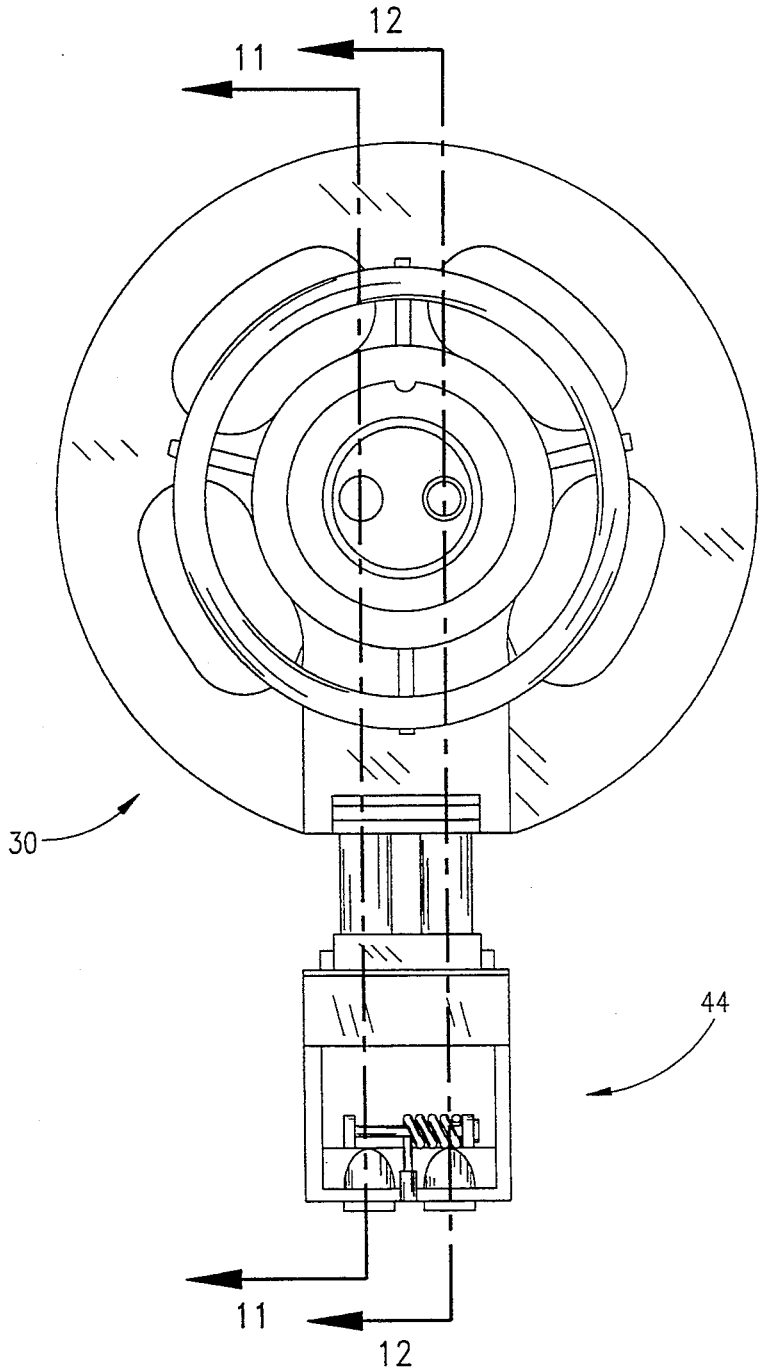
FIG. 12 is a plan view of the support base, head and pinch valve arrangement.
Figure 13:
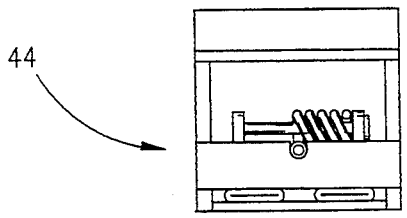
FIG. 13 is a fragmentary front elevation view of the pinch valve showing the tubes pinched.
Figure 14:
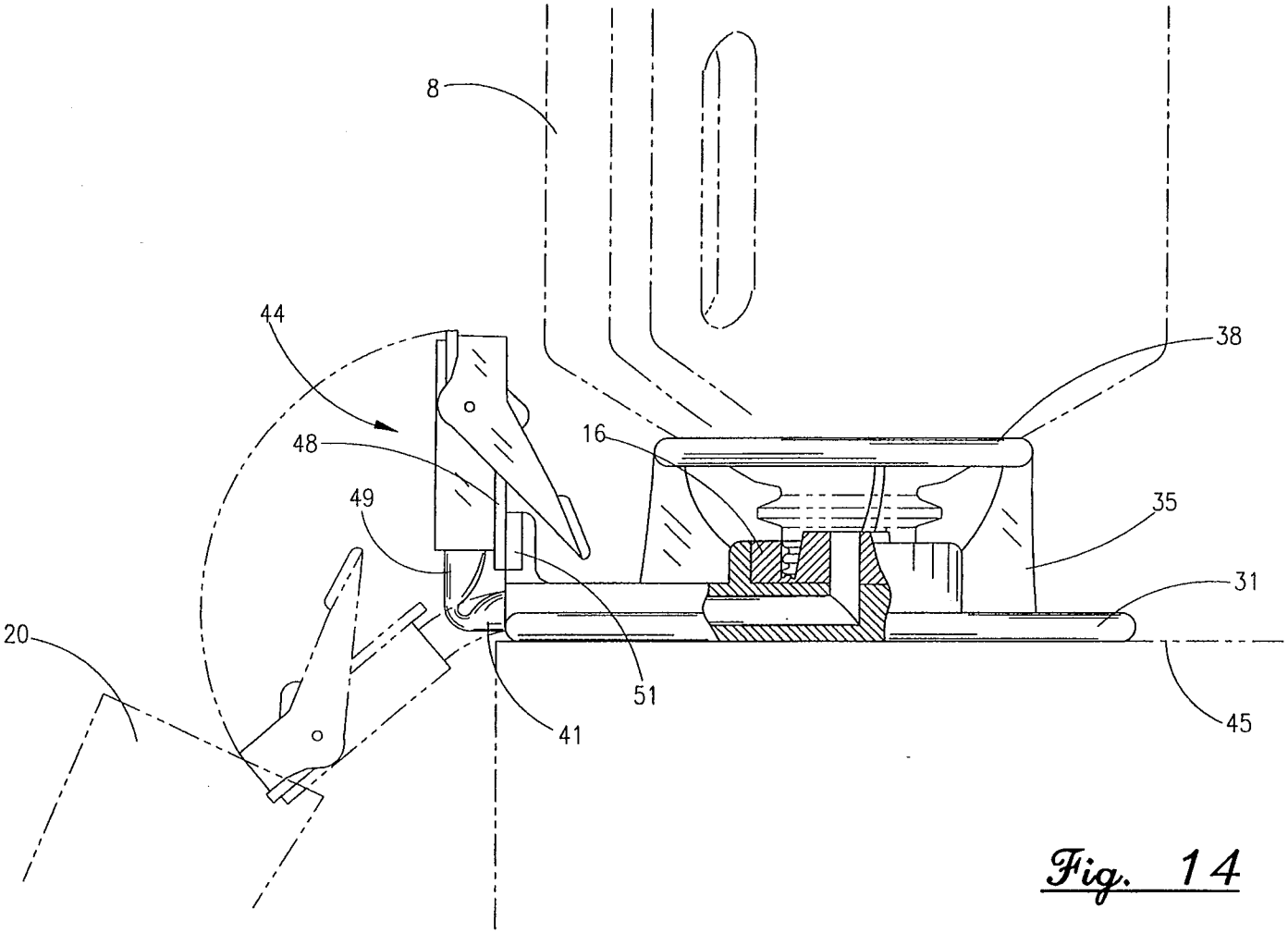
FIG. 14 is a right side elevation of the base support embodiment arrangement supported by a shelf, showing a plastic, gallon jug in the inverted position and the pinch valve arranged for dispensing the jug's contents into a glass.

Turning now to FIG. 9, the apparatus 30 further utilizes the dispensing technology of the "tilt and pour" dispensing head 2 apparatus described above for use in supporting large containers such as gallon jugs 8 as well as two and three liter, soft drink containers when placed in the inverted position. Plastic jugs 8 are not designed to be inverted with the weight of their contents placed on the neck of the container. Therefore, such containers collapse or tilt over, under their own weight. It is not only essential that the base be sufficient to provide support, but the container 8 must be supported in a manner which provides structural support and a center of gravity which resists tipping. In looking at the apparatus in FIG. 9 we see a flat base plate 31 which is essentially the same diameter of most gallon jugs 8. Finger openings, located 33 around the base, are provided to assist the user in orientating the apparatus 30 while applying pressure and rotation when securing the apparatus 30 to the liquid container 8. The central hub 34 portion, which emulates the head 2 in the "tilt and pour" embodiment now seen in FIGS. 10, 11, houses the flexible coupling 16 described in the "tilt and Pour" apparatus above. Webs 35 attached to the central hub 34 provided the structural support for the stabilizer ring 38. The two external vent and liquid ports 3, 5 are now fitted with flexible extension tubes 40, 41, leading to a spring 43 loaded pinch valve 44 which maintains tension on a pivotal crimping bar 46 and handle 47, thereby crimping the flexible tubes 40, 41 forming a positive seal, as seen in FIGS. 11 & 13. To provide a secure place for the dispensing pinch valve 44 a magnet bracket 50 is provided whereby the dispensing pinch valve 44 is simply lifted vertically, thus crimping the flexible tubes. The valve 44 is then held in place in a docking manner by magnetic contact between the valve magnet 48 and the base magnet 51. This arrangement, as seen in FIG. 14, illustrates the crimping of the flexible tubes 40, 41, thus producing a second pinch point 49, thereby insuring non-leakage. To install the apparatus 30 on a container the user simply uses the finger openings 33 to control and orientate the head about the neck of a container by applying pressure while rotating the head, thus obtaining a friction seal both inside and outside the container's neck regardless of thread orientation. A removable, rigid vent tube 4 can be used in this arrangement due to the container remaining in the vertical position.

To use the inverted container arrangement as shown in FIG. 14, as described, the container 8 and support apparatus 30 can be placed on a counter or on a refrigerator shelf 45. The user simply pulls on the dispensing valve 44 thereby breaking the magnetic attraction and allowing the dispensing valve 44 to be flexibly positioned into a glass or cup 20, as seen in FIG. 14. By holding the glass 20 in one hand, the valve handle 47 is depressed with the free hand thereby releasing the container's contents at a controlled rate. Releasing the valve handle instantly stops the flow of liquid. The present invention improves upon the prior art by eliminating the need for a tubular member having the same contour as that of the bottle, provides a more efficient sealing means for the neck of the bottle by sealing both internally and externally while not relying on the bottle's threads and reduces the physical displacement requirement of the apparatus. The present invention further provides a more positive sealing of the vent and liquid tubes by double crimping or snap closure of the cap thereby eliminating the need for an expensive valve. The present invention further avoids the short comings of the prior art by utilizing a manually operated, spring closure means for the parallel vent and liquid line passages in one embodiment in place of a valve or manual crimping means.

What is claimed is:

1. An improved, liquid dispensing apparatus for disposable, plastic bottles comprising:

a) a head portion;

b) a flexible coupling means demountably attached to said head portion having inner and outer sealing means for frictionally connecting to the open neck portion of disposable bottles;

c) cavities located within said head portion for connecting communicative passages in said flexible coupling means with external vent and liquid ports located at the edge of said head portion;

d) a biased closure means adjacent said external vent and liquid ports for operably opening and sealing said ports; and e) a vent tube inserted in one of said passages located in said flexible coupling.

2. An improved, liquid dispensing apparatus for disposable bottles according to claim 1 wherein said coupling means comprises:

a) a disk shaped, unitary piece of pliable material having an exposed surface and a concealed surface;

b) a conic shaped, central portion extending above said exposed surface;

c) a groove having a vertical, outer wall and anticline base integral with and surrounding said central portion, extending below said exposed surface; and d) at least two passages perpendicular to said exposed surface passing through said central portion communicative with internal ports in said head.

3. An improved, liquid dispensing apparatus for disposable bottles according to claim 2 wherein said conic shaped, central portion is frictionally pressed inside the opening in the neck of a bottle forming a liquid seal, and wherein said integral surrounding groove is deformingly fitted over the neck of said bottle thereby providing a second seal, and said anticline shaped ridge forming the base of said groove further sealing the leading edge of said bottle neck.

4. An improved, liquid dispensing apparatus for disposable bottles comprising:

a) a rigid head portion having internal cavities connecting liquid and vent internal ports with liquid and vent external ports located at the peripheral edge of said head;

b) a deformable coupling means having inner, outer and edge sealing means, adhered to said head portion for connecting said head to the open neck of a disposable bottle;

c) at least two passages passing through said coupling for communicating with said internal head ports;

d) closure means attached to said head adjacent said external vent and liquid ports, biasingly operable, for opening and sealing said ports;

e) a rigid vent tube having a curved flexible portion attached thereto, frictionally inserted in one of said passages in said deformable flexible coupling; and f) an orifice reducer attached to the free end of said vent tube's flexible portion.

5. An improved, liquid dispensing apparatus for disposable bottles according to claim 4 wherein said closure means further comprises:

a) a cap pivotally attached to said head portion adjacent said external ports;

b) a handle means attached to the exterior of said cap;

c) a sealing means attached to the interior of said cap for sealing said outlet ports; and d) an indent means for holding said cap in the fully open position.

6. An improved, liquid dispensing apparatus for disposable bottles according to claim 5 wherein said deformable coupling means comprises:

a) a single piece of disk shaped, resilient material having a conic shaped, central portion extending above an exposed surface of said piece;

b) a concentric groove surrounding and integral with said central portion having a vertical outer wall and anticline base, extending below said exposed surface; and c) at least two passages perpendicular to said exposed surface passing through said central portion.

7. An improved, liquid dispensing apparatus for disposable bottles according to claim 2 or 4 wherein said rigid head further comprises:

a) a circular disk base plate having a plurality of finger openings therein;

b) a plurality of support webs attached to said base plate and said rigid head;

c) a stabilizing means attached to and supported by said webs for supporting the shoulder of a disposable liquid container in the inverted position;

d) a pair of short, flexible tubes matingly engaging said liquid and vent ports;

e) a biased closure means integral with said short flexible tubes for holding said tubes in a spaced apart, juxtaposed alignment while maintaining said tubes in a first, closed condition and a second, manually operable, held open condition; and f) a magnetic means attached to said rigid head portion for magnetically latching said biased closure means to said head portion.

8. An improved, liquid dispensing apparatus for disposable bottles according to claim 7 wherein said biased closure means comprises:

a) a housing having front and rear orientation;

b) a pair of juxtaposed, short, flexible tubes disposed within said housing with one end of said tubes flush with the front of said housing and the opposite ends extending a short distance beyond the rear of said housing;

c) an actuating lever means pivotally attached adjacent the front of said housing for applying a pinching action on the leading edges of said tubes thereby closing off flow through said tubes;

d) a biasing means for holding said lever means in said closed position; and e) a magnet means attached to said housing for docking with said magnetic means attached to said rigid head portion.

9. An improved, liquid dispensing apparatus for disposable bottles according to claim 8 wherein said closure means when magnetically latched to said head portion crimps said short flexible tubes thereby providing a secondary closing of said flexible tubes.

10. A method of dispensing a liquid from a disposable bottle with the apparatus of claim 6 comprising the steps of:

a) placing a disposable bottle on a counter or table;

b) opening said bottle;

c) attaching said apparatus securely to the neck of said open bottle;

d) holding a container with one hand;

e) latching said cap in the indented, held open, position; and f) tilting said bottle with the bottle resting on said counter or table, with the opposite hand thus, directing the contents of said bottle flowing from said outlet port into said container.

11. A method of dispensing a liquid from a disposable bottle with the apparatus of claim 9 comprising the steps of:

a) placing a disposable bottle on a counter or table;

b) opening said bottle;

c) attaching said apparatus securely to the neck of said open bottle;

d) inverting said bottle and apparatus;

e) holding a container adjacent said biased closure means for receiving the contents of said disposable bottle;

f) undockinging said dispensing means; actuating said biased handle means;

g) actuating said biased handle means;

h) directing the flow of said bottle's content through said dispensing means, into said container; and i) redocking said dispensing means with said apparatus, thus double sealing said dispensing tubes.

12. An improved, liquid dispensing apparatus for disposable bottles comprising:

a) a head portion having a flexible coupling means for frictional attachment to the open neck portion of disposable bottles;

c) passages connecting outlet ports located at the edge of said head portion with inlet ports located on the face of said flexible coupling communicative with the contents of said bottle;

d) closure means adjacent said outlet ports for manually, opening and closing said ports;

e) a biasing means for holding said closure means in the closed position;

f) a sealing means adhered to said closure means for sealing said outlet ports;

a vent tube inserted in one of said passages located in said flexible coupling;

h) an orifice reducer inserted in one end of said vent tube; and i) an indent means for holding said closure means in a held open position.

13. An improved, liquid dispensing apparatus for disposable bottles according to claim 12 wherein said coupling means comprises:

a) a unitary piece of pliable material having two faces for attachment to said head portion;

b) a conic shaped, central portion extending above one of said faces;

c) a groove surrounding said conic shape with said central portion forming one wall and having an anticline base; and d) passages perpendicular to said faces passing through said central portion communicative with the passages in said head portion.

14. An improved, liquid dispensing apparatus for disposable bottles according to claim 13 wherein said conic shaped, central portion is frictionally pressed inside the opening in the neck of a bottle forming a liquid seal, and wherein said surrounding groove is deformingly fitted over the neck of said bottle thereby providing a second seal, and said anticline ridge forming the base of said groove further sealing the leading edge of said bottle neck.

15. An improved, liquid dispensing apparatus for inverted disposable bottles:

a) a head portion having a flexible, coupling means for frictional attachment to the open neck portion of disposable bottles;

b) passages connecting outlet ports located at the edge of said head portion with inlet ports located on the face of said flexible coupling communicative with the contents of said bottle;

c) a circular disk base plate having a plurality of finger openings attached to said head portion;

d) a plurality of support webs attached to said base plate and said head portion;

e) a stabilizing means attached to and supported by said webs for supporting the shoulder of said disposable bottle in the inverted position;

f) a closure means connected to said outlet ports by flexible, tubing means;

g) a magnetic means attached to said head portion for magnetically docking said closure means to said head portion;

h) a handle means for operably opening and closing said closure means; and i) a biasing means for holding said handle means in the closed position.

16. An improved, liquid dispensing apparatus for disposable bottles according to claim 15 wherein said closure means comprises:

a) a housing having a pair of juxtaposed, short, flexible tubes disposed therein, and wherein one end of said tubes is aligned with the front of said housing and the opposite ends of said tubes extend a short distance beyond the rear of said housing;

c) an actuating lever pivotally attached adjacent the front of said housing;

d) a biasing means for holding said leaver means in said closed position; and e) a magnetic means attached to said housing for docking with said magnetic means attached to said rigid head portion.

17. An improved, liquid dispensing apparatus for disposable bottles according to claim 16 wherein said closure means, when magnetically latched to said head portion, crimps said short, flexible tubes thereby providing a secondary sealing of said flexible tubes.

* * * * *